US008984922B2

(12) United States Patent
Roth et al.

(10) Patent No.: US 8,984,922 B2
(45) Date of Patent: Mar. 24, 2015

(54) METHOD OF AND APPARATUS FOR POSITIONING A TOOL

(75) Inventors: Eberhard Roth, Bad Lassphe (DE); Ernst Walter Menn, Hilchenbach (DE)

(73) Assignee: E.W.Menn GmbH & Co. KG, Hilchenbach (DE)

( * ) Notice: Subject to any disclaimer, the term of this patent is extended or adjusted under 35 U.S.C. 154(b) by 742 days.

(21) Appl. No.: 13/092,921

(22) Filed: Apr. 23, 2011

(65) Prior Publication Data

US 2011/0259069 A1 Oct. 27, 2011

(30) Foreign Application Priority Data

Apr. 26, 2010 (DE) ..... 10 2010 018 369
Apr. 21, 2011 (DE) ..... 10 2011 018 678

(51) Int. Cl.
*B21H 3/06* (2006.01)
*B21J 13/00* (2006.01)

(52) U.S. Cl.
CPC ..... *B21H 3/06* (2013.01)
USPC ..... 72/90; 72/446

(58) Field of Classification Search
USPC ..... 72/21.6, 90, 88, 446, 448, 481.1, 481.2
See application file for complete search history.

(56) References Cited

U.S. PATENT DOCUMENTS 3,726,118 A * 4/1973 van de Meerendonk ..... 72/90
4,615,197 A * 10/1986 Allebach ..... 72/88
4,964,326 A * 10/1990 Steinhoff ..... 72/481.1
5,555,757 A * 9/1996 Smith et al. ..... 72/88
2011/0214470 A1* 9/2011 Deplano et al. ..... 72/270

FOREIGN PATENT DOCUMENTS

DE 102005013746 * 10/2005
JP 63-309340 * 12/1988

* cited by examiner

*Primary Examiner* — Shelley Self
*Assistant Examiner* — Mohammad I Yusuf
(74) *Attorney, Agent, or Firm* — Andrew Wilford

(57) ABSTRACT

The invention relates to an apparatus (100) for positioning a tool (21) in a profile rolling machine, comprising a base (10) and at least one spindle (30) extending in a first bore (17) of the base as abutment for the tool (21). A retraction rod (25) serves as connection between the base and the tool (21). A tractive force for the retraction rod (25) is generated by an actuator (50) and the tool is pulled by the retraction rod (25) against a tool stop (23). The first bore (17) is locally expanded to form a cylinder chamber (12). A piston (40) is mounted in an axially displaceable manner in the chamber (12). A pressure medium (M) is introduced via a pressure connection (46) into the base (10) into the cylinder chamber (12) between the base and the piston (40) for applying a force (F1) on the piston (40).

6 Claims, 6 Drawing Sheets

METHOD OF AND APPARATUS FOR POSITIONING A TOOL

The invention relates to a method of and apparatus for positioning a tool in a profile rolling machine.

PRIOR ART

In case of profile rolling machines, in particular screwthread rolling machines, a blank is processed between two tools and by rolling the blank on the profile-generating contact surfaces of the tools, the profile, for example a screwthread, is formed on the blank. During this process, a significant pressure is exerted between the tools and the blank. Here, the blank can gets caught between the tools and cannot be released simply by moving the tools back and forth in the apparatus. The clamping pressure is so high that even the machine drive can no longer move a slide with the tool for opening and/or damages the tools due to the bending occurring here. In order to release the blank from the tool, usually, a high leverage force has to be applied, or the tool or even other components within the installation have to be disassembled. This is very time-consuming and can result in damage to the machine. Moreover, after disassembling the tools, they have to be reassembled and adjusted.

DESCRIPTION OF THE INVENTION

It is the object of the invention to provide a method of and apparatus for positioning a tool in a profile rolling machine that allow a fast and easy opening as well as a fast repositioning of the rolling tool into its starting position. Moreover, cost effectiveness and safety of the installation is to be improved.

This object is solved by an apparatus for positioning a tool in a profile rolling machine comprising a base configured to have at least one first bore, and at least one adjusting spindle having a tool stop, which adjusting spindle is mounted in a position-variable manner in the first bore of the base. A retraction rod is adjustable as to position for positioning the first tool with a tractive force against the tool stop. The first bore is locally expanded to form a cylinder chamber. A piston can move axially in this cylinder chamber. The piston and the cylinder chamber together form a piston-cylinder unit. A pressure connection is provided in the base for introducing a pressure medium with a first pressure into the cylinder chamber between the base and a back piston face directed away from the first tool. Alternatively, instead of the pressure connection, a vacuum connection is provided in the base for introducing a vacuum into the chamber between a piston front face directed toward the tool and the base.

Thus, an apparatus is provided in a profile rolling machine by means of which at least the tools can be opened in a fast and easy manner by the position-variable piston, and after removing the blank from the apparatus, the tool can be repositioned with the piston and adjusting spindle connected thereto into its starting position without the need to carry out complicated adjustment and calibration work. For example in case of damage or during maintenance work on the apparatus, significant time is saved by the apparatus according to the invention. The easy opening of the tool with the position-variable piston ensures a gentle method for releasing the apparatus without additional levers or mechanical impacts that, in the worst case, can result in damage or destruction of the tool or the apparatus. The cost effectiveness and safety of the installation are considerably improved over the prior art.

The constructional alternative of the vacuum connection instead of the pressure connection in the base provides advantageously an alternative possibility of applying force to the piston that can be used in case of failure of the pressure for changing the position of the piston.

In a first configuration of the invention the adjusting spindle is mounted in a third bore in the piston such that it can change its position axially of the piston. The adjusting spindle serves as abutment for the first tool and due to this arrangement, can change its position in a simple and fast manner.

Furthermore, the invention provides that the adjusting spindle and the piston are connected to each other by a screwthread. In this manner, the adjusting spindle can easily be displaced and precisely adjusted or positioned in the right position as tool stop for the tool.

In a further preferred embodiment of the apparatus according to the invention a controller is provided for applying a first pressure for the pressure medium or for applying the vacuum in the chamber, depending on the material and the dimensions of the blank to be rolled. This way it is possible to quickly and flexibly adjust the compression pressure of the tool against a blank. The positioning force of the tool can be adjusted with the control in a simple and accurate as well as fast and flexible manner. With respect to the necessary positioning or pressing forces, the apparatus can be set for many different materials such as stainless steels, standard steels, high-strength steels, nonferrous metals or plastics with different dimensions. Complicated recalibrating is not required so set-up times are significantly reduced.

Furthermore, the invention provides that the controller is configured for controlling the actuator and thus for setting the amount of tractive force on the retraction rod depending on the first pressure or the vacuum in the chamber. As a result, a simple and reliable possibility for positioning or opening the apparatus is provided, wherein, depending on the material properties of the blank to be processed and the blank dimensions, the forces acting on the piston and the retraction rod can be very accurately adapted to each other.

In a further configuration of the invention, the piston is provided on its front face directed toward the tool with a first projecting sleeve that is mounted in the first bore in the base, and/or the piston is equipped on its back face directed away from the tool with a second projecting sleeve that is likewise mounted in another section of the first bore in the base. With this arrangement according to the invention, additional guidance and stable mounting for the piston is created that is in particular advantageous in case of very high forces or long stokes.

In a preferred embodiment of the invention the profile rolling machine is configured as a thread rolling machine.

The method according to the invention for operating the apparatus described above comprises the following steps:

positioning the piston and the adjusting spindle connected thereto and having a tool stop by displacing the piston in the cylinder chamber by introducing a pressure medium into the chamber with a first pressure that generates a force on the piston's back face directed away from the tool such that the piston is displaced against a first abutment of the housing, or by a suction force that acts on the piston and is generated by introducing a vacuum into the chamber between a piston front face directed toward the tool and the base, and pulling the tool against the tool stop by the retraction rod with a tractive force that is generated by the actuator, the tractive force being smaller than the first force or smaller than the suction force and counteracting same.

In a first configuration of the method the tool stop is positioned and adjusted by axially displacing the adjusting spindle in the third bore of the piston.

In a further configuration of the invention, the method according to the invention provides that the adjusting spindle is axially displaced by a screwthread in the third bore. This method step allows a fine adjustment or fine positioning of the tool stop with respect to the previous prepositioning of the tool stop carried out by the piston.

Preferably, the method provides that the controller establishes the first pressure of the pressure medium or the suction force by the vacuum in the chamber and the tractive force applied on the feed spindle to respective predefined values that are each predefined depending on the material and the dimensions of a blank to be shaped.

In one configuration of the method the profile rolling machine can be a thread rolling machine and a screwthread or profile is rolled into the blank.

The method further provides that for releasing or opening the tool, the first force of the pressure medium or the vacuum is reduced or decreased close to zero and the tractive force generated by the actuator and acting on the retraction rod becomes greater than the first force generated by the first pressure or suction force acting on the piston. After force application with the tractive force, the retraction rod with the tool and the adjusting spindle with the piston move together in a rearward direction away from the tool.

Further advantages and details of the invention arise from the sub-claims and the following description in which the embodiments of the invention illustrated in the figures are explained in more detail. Apart from the above-described combinations of features, the features are also essential for the invention as individual features or in other combinations.

DESCRIPTION OF THE FIGURES

The invention is described in detail hereinafter with reference to FIGS. 1 to 5. Therein:

FIG. 1 shows an apparatus 100 for positioning a tool 21 in a profile rolling machine. A base 10 has at least one first bore 17 through which extends an adjusting spindle 30 having a front end forming a tool stop 23. The spindle 30 has a rear part 38 axially slidable in the first bore 17 of the base 10. A retraction rod 25 is axially shiftable for applying to a movable tool 21 an axial rearward retraction force F2 relative to an axially fixed tool or die 22 and against the stop 23. In this retracted position the tool 21 bears axially rearward against a front face 24 of the tool stop 23 of the adjusting spindle 30. Preferably, the retraction rod 25 extends through a second bore 28 in the base 10. The second bore 28 also serves as a guide for the retraction rod 25.

Figure 1:
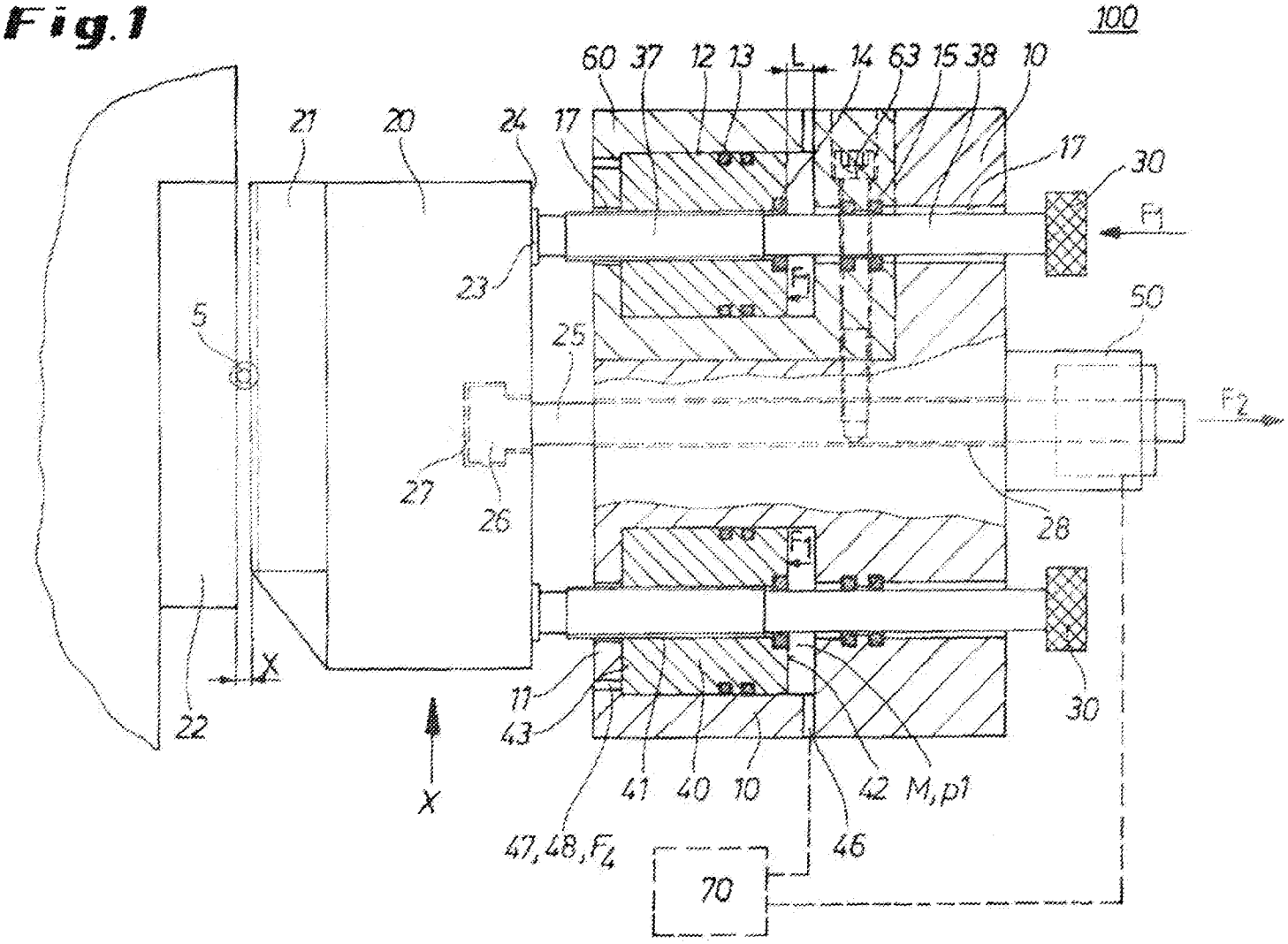
FIG. 1 shows the apparatus during profile rolling in an adjustment position closed on the blank.

The retraction rod 25 is connected to the tool 21 by a first connection 26, here a T-head mounted in a guide groove 27. In this embodiment, the tool 21 can easily be mounted as an exchangeable part on the retraction rod 25. To this end, the T-head 26 is simply slid into the guide groove 27. Alternatively, a simple screw or pin between the tool 21 and the retraction rod 25 can also be selected or the retraction rod 25 can be directly connected to the tool 21 by a weld.

The axially rearwardly directed tractive force F2 acting on the retraction rod 25 in a direction away from the tool 21 is generated by an actuator 50. The actuator 50 is preferably connected to the base 10, but can also be attached to the base frame of the profile rolling machine or, for example, to a separate mounting frame. The actuator 50 is usually a fluid-powered piston-cylinder unit powered by air, oil or hydraulic fluid, but, alternatively, can also be a spring, for example a compression spring, or elastomeric body.

In a further embodiment the retraction rod 25 is connected first to a tool support 20 as adapter between the retraction rod 25 and the tool 21 and to fasten the tool 21 as detachable or exchangeable attachment part, for example by a screw connection, to the tool support 20. In this manner, the apparatus can easily be adapted to different tasks and loads of the profile rolling process, for example by using reinforced tool supports 20 or different tools 21 as exchangeable parts in the apparatus.

The first bore 17 has a region of enlarged diameter toward its front rear end and forms a cylindrical chamber 12 surrounding the spindle 30. A piston 40 surrounding the spindle 30 can shift axially in the enlarged chamber 12. The cylindrical chamber 12 and the piston 40 form a piston-cylinder unit. The first bore 17 and the chamber 12 can be formed directly in the base 10 or, alternatively, as illustrated in a partial view of FIG. 1, can be at least partially in a separate subhousing 60 that is connected by a second connection 63, for example a screw as exchangeable part to the base 10. This alternative improves serviceability by making possible a faster exchange of only the exchangeable part.

At least one first seal 13 is provided between the piston 40 and the cylinder chamber 12, a second seal 14 is provided between the piston 40 and the adjusting spindle 30, and a third seal 15 is provided between the adjusting spindle 30 and the base 10 to prevent leakage of a pressure medium M or a vacuum in the chamber 12. The pressure medium is usually air, oil or hydraulic fluid.

A pressure medium M is introduced through a connection 46 in the base 10 at a first pressure p1 into the cylinder chamber 12 for applying a first force F1 against a back face 42 of the piston 40 directed away from the first tool 21. The piston 40 axially displaceable in the chamber 12 moves through a stroke L when subjected to a first force F1, the stroke being limited by an abutment formed by a front end wall 11 of the cylinder chamber 12. As illustrated, the abutment can be integrally connected to the base 10 or can be formed as an attachment, for example in the form of a plug-in or screw-in sleeve or a retaining ring. This embodiment allows such plug-in or screw-in sleeves with different lengths to be exchangeable parts fittable in the base 10 so the abutment for the piston 40 can be changed for example by rotating the plug-in sleeves in the first bore 17. The maximum stroke of the piston 40 is limited in that the pistons front face 43 directed toward the tool 21 directly engages the abutment formed by the front wall 11.

A vacuum connection 47 is provided in the front wall of the housing 10 through which a vacuum 48 can be applied to the chamber 12 between the front wall 11 and the front face 43 directed toward the tool so as to pull the piston 40 by a suction force F4 toward the front wall 11.

The adjusting spindle 30 has a front part 37 extending through a third bore 41 in the piston 40 and axially displaceable relative to the piston 40. The third bore 41 in the piston 40 is internally threaded and the front part 37 is complementarily externally threaded and screwed into the third bore 41. Usually, a fine or trapezoidal is provided between the front part 37 and the third bore 41 so as to allow for a precise positioning and a fine adjustment of the adjusting spindle 30.

As shown in FIG. 1, a controller 70 sets the first pressure p1 or the vacuum 48 in the chamber 12 and sets the tractive force F2 acting on the retraction rod 25 depending on the material and the outer dimensions of a blank 5 to be rolled in the profile rolling machine. Thus, the pressures p1, p2 and p3 or, the vacuum 48 and the pulling and/or forces F1, F2, F3 or, the suction force F4, generated therefrom for the piston 40 and the retraction rod 25 are precisely matched to each other. A detailed description of the procedures is illustrated as operational sequence in the FIGS. 5*a* to 5*e*.

Figure 2:
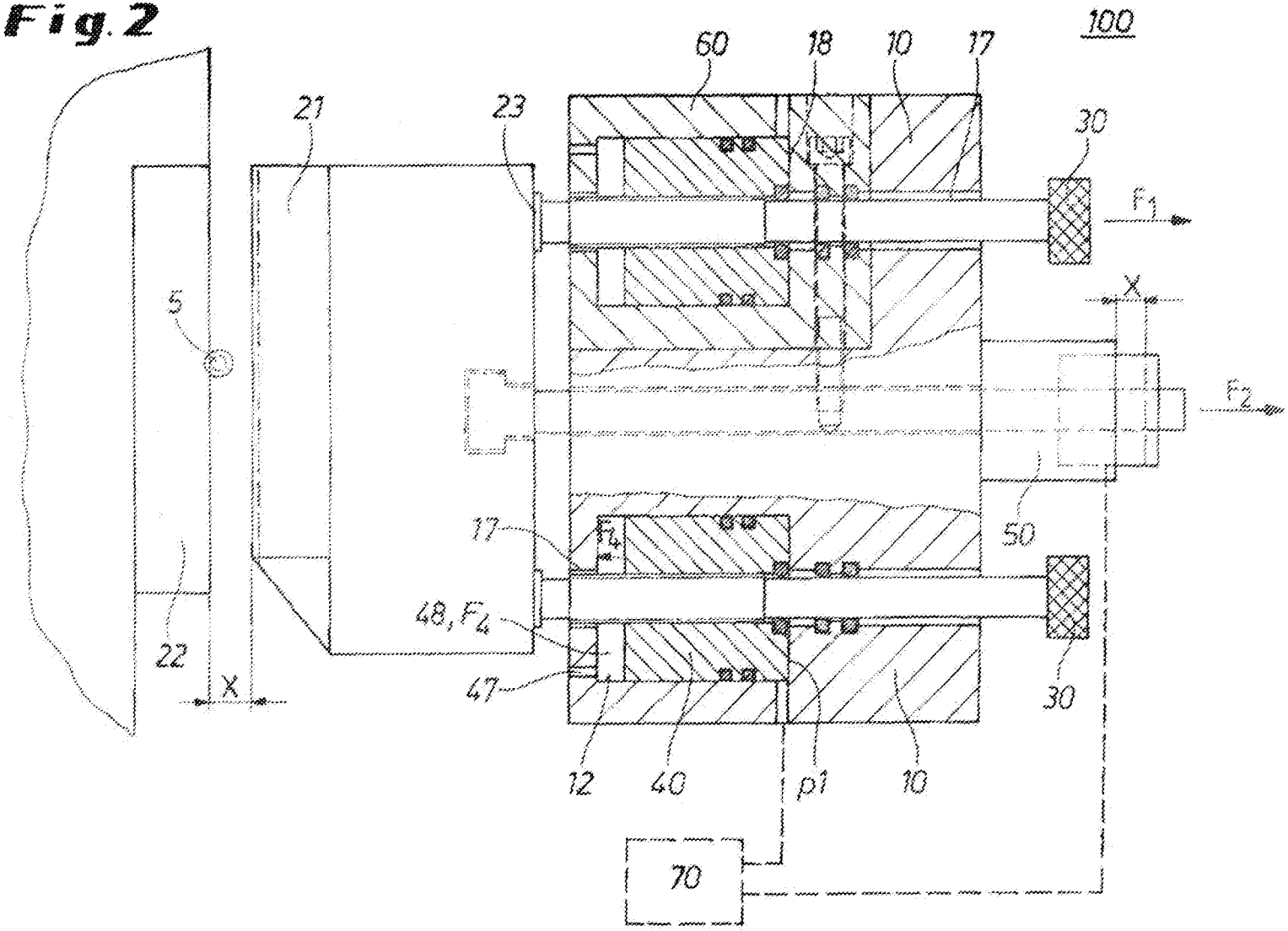
FIG. 2 shows the apparatus after profile rolling in an open position relative to the blank.

FIG. 2 shows the apparatus 100 after the profile rolling in a position that is open with respect to the blank 5. The movable tool 21 is separated by a gap X from the fixed tool or die 22. In this illustrated adjustment position, the blank 5 can be moved freely between the tool 21 and the die 22. The first pressure p1 or the vacuum 48 in the chamber 12 is set to almost zero. The actuator 50 shifts the retraction rod 25 rearward through a stroke corresponding to the gap X, that is in a direction away from the tool 21. The tool 21 is positioned against the abutment end face 23 of the adjusting spindle 30. In the cylinder chamber 12, the piston 40 abuts rearward, that is in a direction away from the tool 21, against a third abutment 18 formed by the rear end face of the chamber 12.

Figure 3:
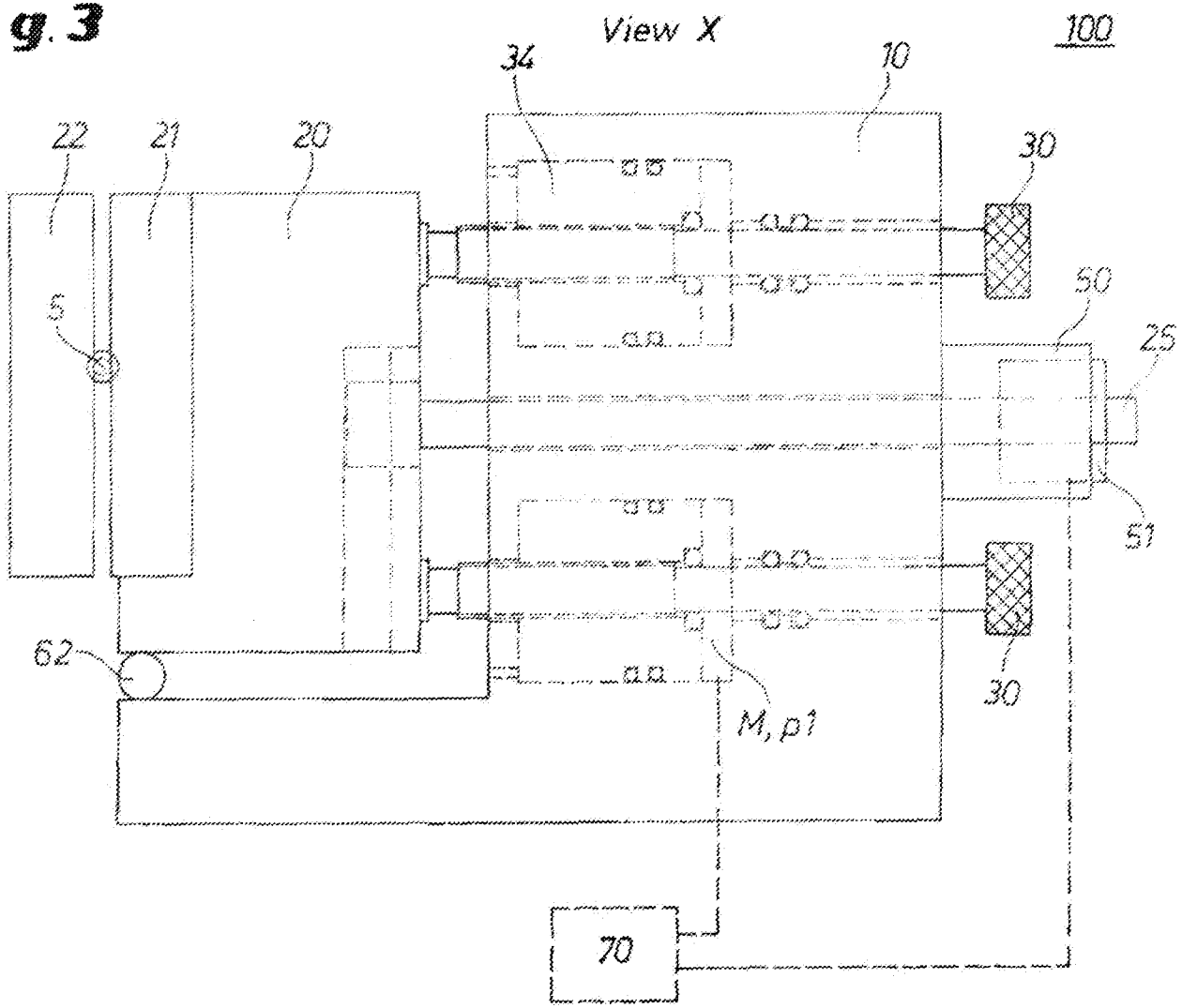
FIG. 3 is a side view of the apparatus.

FIG. 3 shows the apparatus 100 in a side view. A roller or slide 62 between the tool 21 and the base 10 supports and guides the tool 21 and/or its support 20 during axial displacement when positioning the tool 21 against the blank 5. As illustrated, the roller 62 can be a cylinder or a ball. Alternatively, a flat sliding element 62 in the form of a slide nut is conceivable.

Figure 4:
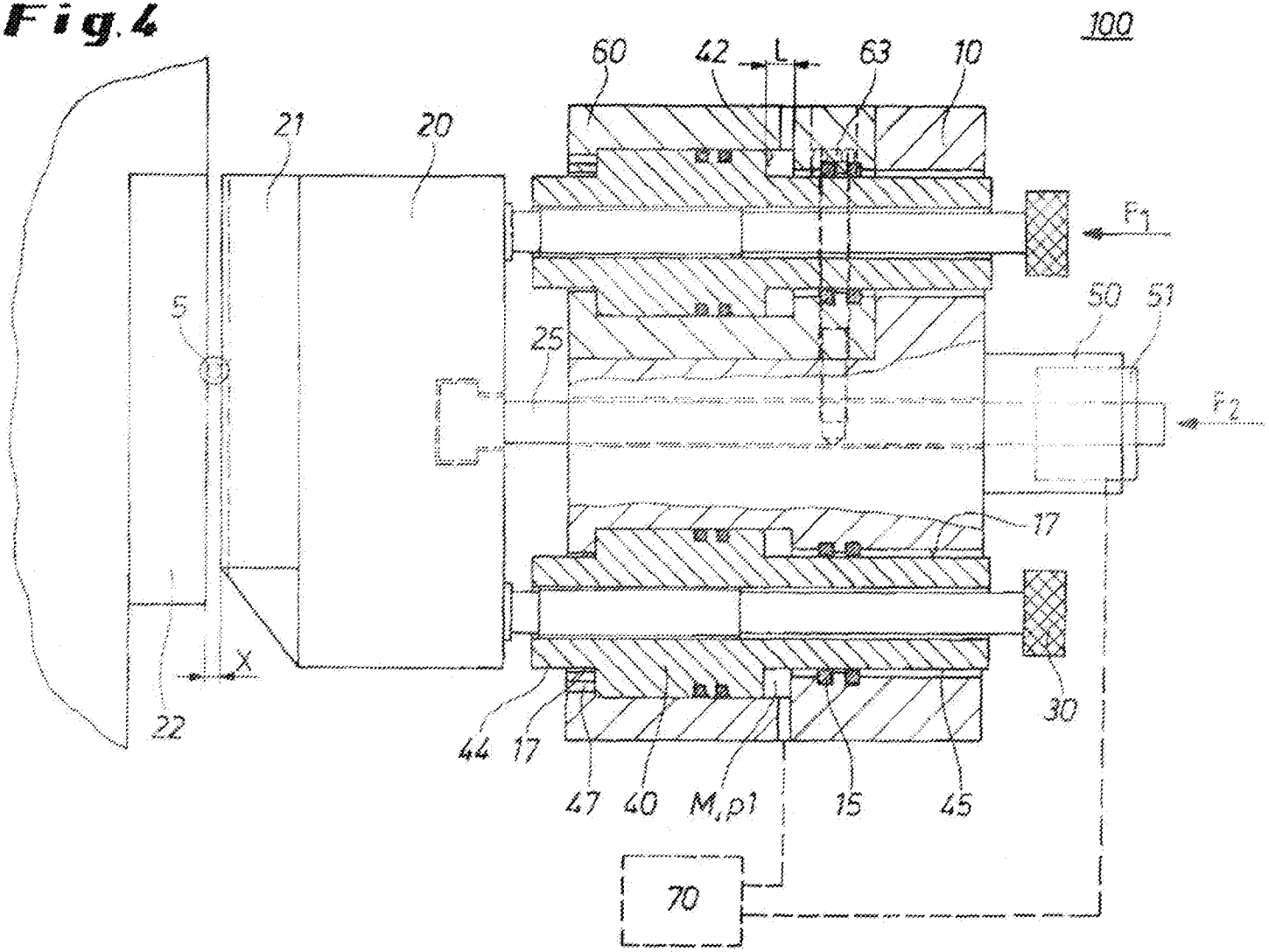
FIG. 4 shows an alternative embodiment of a piston in the apparatus, the apparatus being shown in an adjustment position closed on the blank.

FIG. 4 shows an alternative embodiment of the apparatus 100 in an adjustment position (also shown in FIG. 1) closed with respect to the blank 5. In this embodiment, the piston 40 has an axially forwardly projecting front extension sleeve 44 extending from its front end toward the tool 21 and this sleeve 44 is mounted and guided in the first bore 17 in the front wall of the base 10. Furthermore, on the back face 42 directed away from the tool 21, the piston 40 has an axially rearwardly projecting rear extension sleeve 45 that also slides in the first bore 17 in the base 10. Depending on the design it is advantageous if the projecting sleeves 44 and 45 have different diameters and the first bore 17 is complementarily shaped. In order to prevent the pressure medium M or the vacuum 48 from leaking out of the chamber 12, respective seals 13, 15 are provided between the piston 40 and the chamber 12 and between the second projecting sleeve 45 and the first bore 17.

Figure 5A:
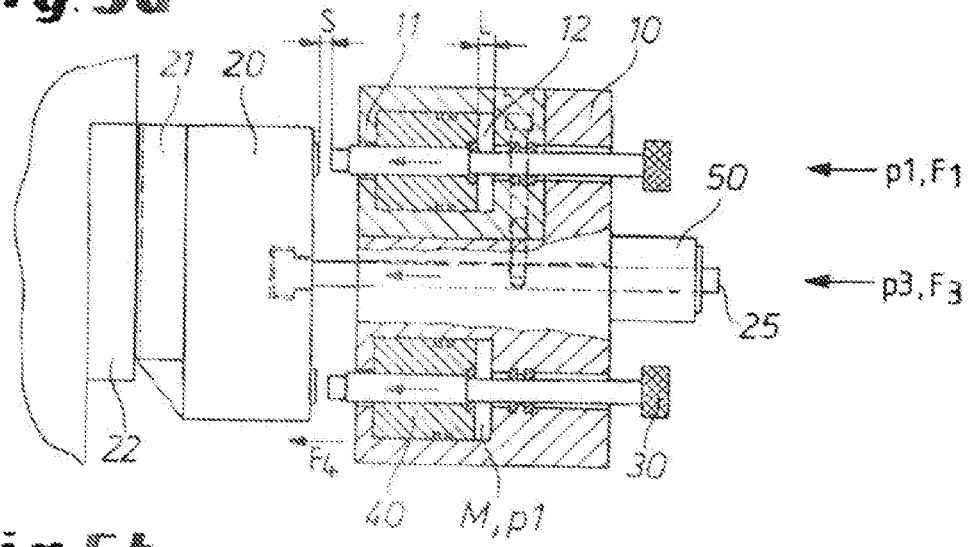
FIGS. 5*a*-5*e* show the operation of the apparatus.

The apparatus 100 operates as shown by FIGS. 5*a* to 5*e* as follows:

FIG. 5*a* shows the apparatus 100 in a zero position for adjusting the spindle 30. The actuator 50 applies the pressure p3 to the retraction rod 25 so it engages with a force F3 against the tool 21 and presses same forward toward the die 22. The pressure medium M creates the first pressure p1 in the chamber 12 against the back face 42 of the piston 40 to apply to it an axially forwardly directed force F1 and press the piston 40 forward against the abutment formed by the front wall 11. Alternatively, the piston 40 can also be displaced by a vacuum 48 in the chamber 12 by suction force F4 against the abutment 11. The displacement of the piston 40 and the associated synchronous displacement of the adjusting spindle 30 determines the gross stop position or displacement path s for the tool 21.

Figure 5B:
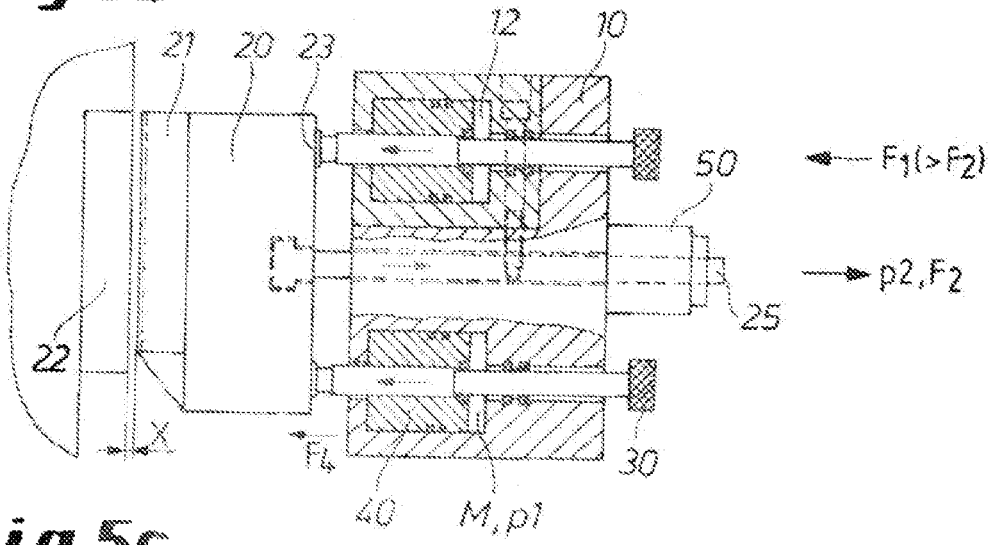

FIG. 5*b* shows the apparatus in an operating position with a gap X between the tool 21 and the die 22 so there is space for the blank 5 to be formed. In this working position, the first pressure p1 of the pressure medium M or the vacuum 48 is adjusted by the controller 70 depending on the tractive force F2 acting on the retraction rod 25 in such a manner that a first force F1 or, in case of the vacuum 48, a suction force F4 applied in the chamber 12 to the piston 40 that is greater than the tractive force F2 of the retraction rod 25. This ensures that the piston 40 moves forward into an end position against the front-wall abutment 11 in the housing 10 and the tool 21 engages in an operating position against the stop formed by the end face 23 of the adjusting spindle 30.

Figure 5C:
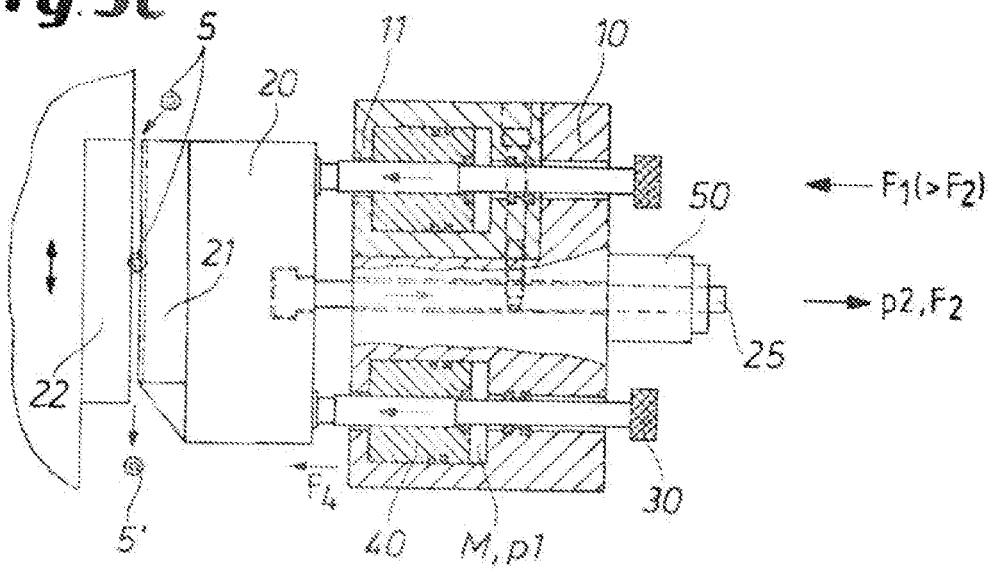

FIG. 5*c* is the same as FIG. 5*b*, but, in addition, the blank 5 is shown here pulled for the machining process into the gap X between the tool 21 and the die 22.

Figure 5D:
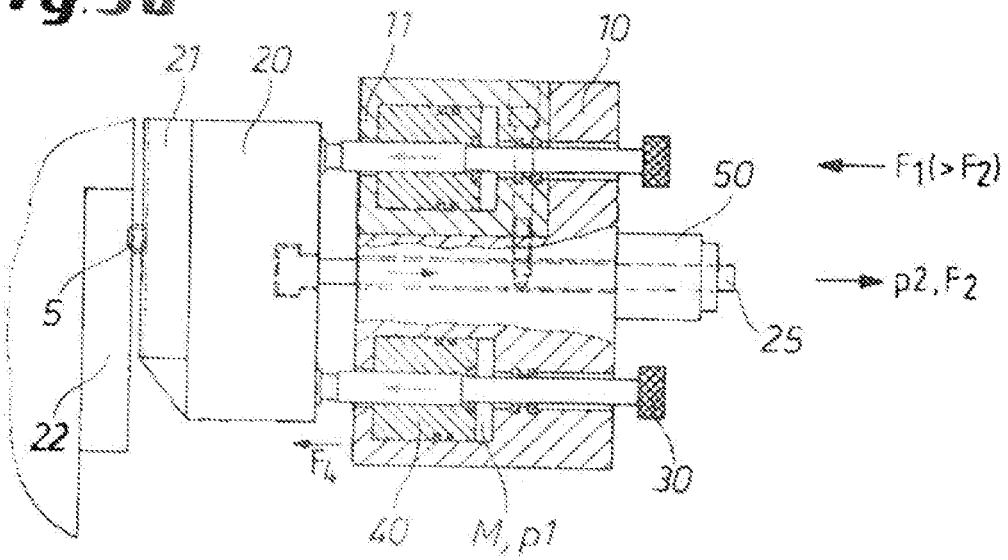

FIG. 5*d* shows the position of the apparatus 100 for example in case of a malfunction when the blank is already unevenly deformed between the tool and the die during profile rolling thereby jams the apparatus 100 so further production is no longer ensured. The pressure or force conditions as well as the stop position of the tool 21 and the piston 40 correspond to those described in connection with FIGS. 5*b* and 5*c*.

Figure 5E:
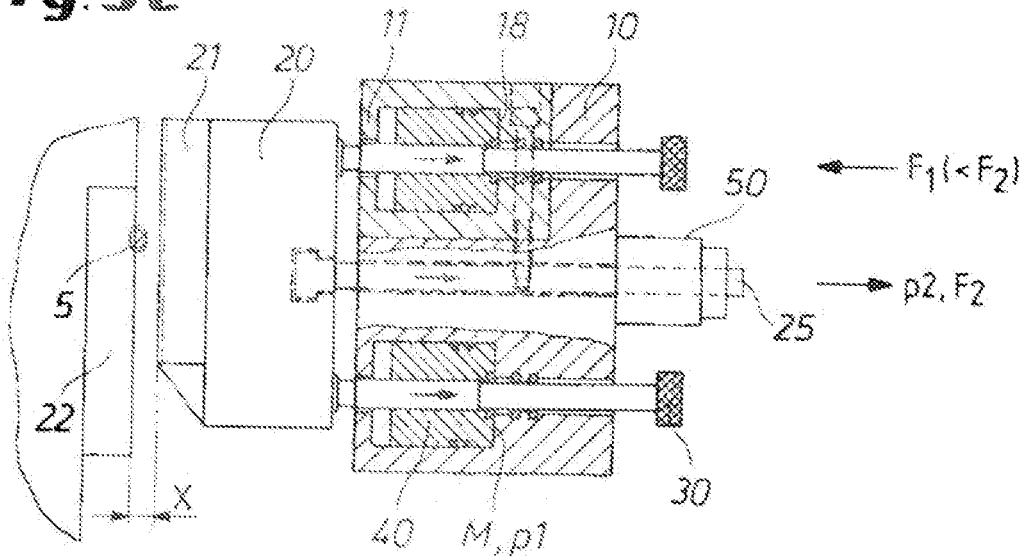

FIG. 5*e* shows the releasing or opening of the apparatus 100. To do this, the pressure or force conditions acting on the piston 40 and on the retraction rod 25 are changed. The first pressure p1 of the pressure medium M or the vacuum 48 is reduced to a value close to zero. The tractive force F2 generated by the actuator 50 acts axially rearward, away from the tool 21 on the retraction rod 25, with the tool 21 bearing with the tractive force F2 against the tool stop 23 of the adjusting spindle 30, and the tool 21 with the retraction rod 25 and the adjusting spindle 30 with the piston 40 move together axially rearward away from the tool 21 until the piston 40 abuts against the third abutment 18 in the chamber 12. The gap X is now at a maximum so that the blank 5 can be removed.

The technical features represented by the reference numbers are equivalent in all figures and are explained in the reference list below.

| Reference list | |
|---|---|
| 5 | Blank |
| 10 | Base |
| 11 | First abutment |
| 12 | Chamber |
| 13 | First seal |
| 14 | Second seal |
| 15 | Third seal |
| 17 | First bore |
| 18 | Third abutment |
| 20 | Tool support |
| 21 | Tool |
| 22 | Die (= counter tool) |
| 23 | Tool stop |
| 24 | Pressure surface |
| 25 | Retraction rod |
| 26 | First connection |
| 27 | Guide groove |
| 28 | Second bore |
| 30 | Adjusting spindle |
| 37 | Front part |
| 38 | Rear part |
| 40 | Piston |
| 41 | Third bore |
| 42 | Back face |
| 43 | Front face |
| 44 | First projecting sleeve |
| 45 | Second projecting sleeve |
| 46 | Pressure connection |
| 47 | Vacuum connection |
| 48 | Vacuum |
| 50 | Actuator |
| $60_{35}$ | Housing |
| 62 | Sliding element |
| 63 | Second connection |
| 70 | Controller |
| 100 | Apparatus |

-continued

| Reference list | |
|---|---|
| $s_{40}$ | Displacement path |
| X | Gap |
| F1 | First force (adjusting spindle) |
| F2 | Tractive force |
| $F3_{45}$ | Second force (retraction rod) |
| F4 | Suction force |
| p1 | First pressure |
| p2 | Second pressure |
| $p3_{50}$ | Third pressure |
| M | Pressure medium |

The invention claimed is:

1. An apparatus for positioning a tool in a profile rolling machine, the apparatus comprising:

a base having a first bore extending along an axis and locally expanded to form a cylinder chamber;

a adjusting spindle having a tool stop and axially movable in the first bore of the base;

a retraction rod whose position is adjustable for positioning the tool against the tool stop with a tractive force, an actuator for applying the tractive force;

a piston movable axially in the chamber, forming together with the chamber a piston-cylinder unit, having a front face turned toward the tool and an opposite back face, and connected to the adjusting spindle;

a pressure connection in the base for introducing a pressure medium with a first pressure into the chamber between the base and the back face of the piston, or, instead of the pressure connection, a vacuum connection in the base for introducing a vacuum into the chamber between the front face of the piston directed toward the tool and the base; and a controller for setting the first pressure for the pressure medium or for setting the vacuum in the chamber depending on a material and dimensions of a blank to be rolled.

2. The apparatus according to claim 1, wherein the adjusting spindle is axially movable mounted in a respective bore in the piston.

3. The apparatus according to claim 2, wherein the adjusting spindle and the piston are connected to each other by a screwthread.

4. The apparatus according to claim 1, wherein the controller is configured for controlling the actuator for varying the tractive force acting on the retraction rod depending on the first pressure or the vacuum in the chamber.

5. The apparatus according to claim 1, wherein the piston has a first projecting sleeve formed on the front face, directed toward the tool, and displaceable in the first bore and/or the piston has a second projecting sleeve formed on the back face and the displaceable in the first bore in the base.

6. The apparatus according to claim 1, wherein the profile rolling machine is a thread rolling machine.

* * * * *